US005799875A

United States Patent [19]

Weinstein et al.

[11] Patent Number: 5,799,875

[45] Date of Patent: Sep. 1, 1998

[54] HVLP SPRAY GUN AND INTEGRATED FLUID NOZZLE THEREFOR

[75] Inventors: Richard Weinstein, Toledo, Ohio; David M. Seitz, Temperance, Mich.

[73] Assignee: Asahi Sunac Corporation, Japan

[21] Appl. No.: 787,528

[22] Filed: Jan. 21, 1997

Related U.S. Application Data

[63] Continuation-in-part of Ser. No. 413,796, Mar. 30, 1995, abandoned.

[51] Int. Cl.[6] ..... B05B 1/28

[52] U.S. Cl. ..... 239/296; 239/417.3

[58] Field of Search ..... 239/290, 296, 239/299, 416.5, 417.3, 423, 424, 424.5

[56] References Cited

U.S. PATENT DOCUMENTS

| | | | |
|---|---|---|---|
| 1,990,824 | 2/1935 | Gustafsson | 239/296 |
| 2,214,035 | 9/1940 | Tracy | 239/290 X |
| 2,249,771 | 7/1941 | MacMartin | 239/300 |
| 2,737,415 | 3/1956 | Wheeler | 239/290 |
| 2,780,496 | 2/1957 | Asbeck et al. | 239/290 |
| 2,895,686 | 7/1959 | Peeps | 239/290 X |
| 3,037,709 | 6/1962 | Bok et al. | 239/290 X |
| 4,537,357 | 8/1985 | Culbertson et al. | 239/290 |
| 5,064,119 | 11/1991 | Melette | 239/8 |
| 5,090,623 | 2/1992 | Burns et al. | 239/301 |
| 5,165,605 | 11/1992 | Morifa et al. | 239/296 |
| 5,199,644 | 4/1993 | Haferkorn | 239/296 |
| 5,209,405 | 5/1993 | Robinson et al. | 239/296 |
| 5,236,129 | 8/1993 | Grime et al. | 239/528 |

FOREIGN PATENT DOCUMENTS

| | | | |
|---|---|---|---|
| 838633 | 11/1937 | France | 239/290 |
| 522351 | 6/1940 | United Kingdom | 239/296 |

*Primary Examiner*—Kevin Weldon

*Attorney, Agent, or Firm*—John C. Purdue; David C. Purdue

[57] ABSTRACT

An improved HVLP spray gun which operates from an air supply source and an improved nozzle therefor are disclosed. The HVLP gun has a fluid nozzle including a first, integral, laterally extending portion including pressure reduction orifices which are calibrated, relative to a fluid passage in the nozzle, so that the spray gun operates as an HVLP spray gun. The fluid nozzle includes a second laterally extending portion including a surface, against which atomization air impinges after exiting the calibrated pressure reduction orifices, and a plurality of longitudinally extending air distribution holes, wherein atomization air, after passing through the calibrated pressure reduction orifices, is directed radially outwardly in an expansion chamber where the low velocity air is pressure equalized before exiting through the air distribution holes and being directed within the air cap inwardly toward a fluid atomizing annulus. An improved air driven HVLP paint spray gun which is especially lightweight and can be used to spray all types of coating materials including corrosive waterborne paints is also disclosed. A spray gun having a reduced trigger force needed to activate the gun is also disclosed. It is preferred that the leading edge of the fluid tip is doubly tapered so as to introduce the pressurized air directly onto the exiting fluid stream, which produces finer atomization with lower air volume consumption.

15 Claims, 3 Drawing Sheets

HVLP SPRAY GUN AND INTEGRATED FLUID NOZZLE THEREFOR

REFERENCE TO RELATED APPLICATION

This is a continuation-in-part of application Ser. No. 08/413,796 filed Mar. 30, 1995, now abandoned.

BACKGROUND OF THE INVENTION

1. Field of the Invention

This invention relates to the field of spray guns for the spray application of liquid coatings. More specifically, the invention primarily relates to improvements in spray guns of the type known as high volume, low pressure (hereafter, "HVLP") including a novel fluid nozzle assembly with integral pressure reduction and air volume control capabilities, an improved trigger fulcrum assembly, an improved construction based upon the use of components made of aluminum or of an aluminum alloy in place of components that have conventionally been made of stainless steel, and an exterior nozzle configuration which provides improved atomization.

2. Description of the prior Art Compressed air spray guns are adjustable and are capable of producing finely atomized particles by using high pressure atomizing air or they can produce large atomized particles by using an appropriate cap and nozzle and employing HVLP air for the atomizing air at the gun cap. When guns are adjusted to high cap pressures, the paint is atomized into very small particles which results in smooth high gloss paint coatings such as are observed on automobiles. When many of the atomized particles are very small and light they can be blown past the target into the surrounding air by the high velocity of the surrounding atomizing air or merely drift into the surrounding ambient air. Transfer efficiencies, as a consequence, are poor and air pollution can also occur. The cost effectiveness of high pressure air atomizing has dropped drastically as the cost of paint has risen.

HVLP atomizer guns were developed which expanded the low adjustment end of the standard conventional spray guns. These guns use baffles to reduce the incoming high pressure from air compressor lines in order to supply reduced cap air pressures and also use specially designed air caps and fluid nozzles to enhance this form of atomization. U.S. Pat. No. 5,209,405 (Robinson et al.), the disclosure of which is hereby incorporated herein by reference, describes a separate removable baffle which acts as a pressure reduction means for atomizing air and pattern control air in combination. Yet other gun designs use some form of pressure reduction within a part of the gun body before the high pressure air reaches the spray head portion of the apparatus. This type of configuration is seen in U.S. Pat. No. 5,064,119 (Melette), where a variable adjustment of the atomizing air is accomplished by adjustment of an air valve stem located in the gun body air passage. The HVLP method of atomization produces a large distribution of medium and relatively large atomized particles which, partly due to the low velocity of the atomizing air exiting the spray cap assembly, will strike and attach themselves to the target being coated. This results in more of the atomized paint reaching and attaching to the target surface with higher transfer efficiencies, lower air pollution, and more efficient paint usage, but with somewhat coarser surface finishes. This type of gun has proven to be useful where high gloss surface finishes are not required.

To keep the weight of the guns light so as to reduce operator fatigue, gun bodies are fabricated of aluminum but, because corrosive materials may be sprayed, it has been necessary to fabricate the fluid chambers of stainless steel, which increases the weight of these guns. This is exemplified in U.S. Pat. No. 4,537,357 (Culbertson et al.). This spray gun clearly claims a separate fluid section assembled at the front end of the device. U.S. Pat. No. 5,090,623 (Burns et al.) shows a corrosion resistant insert pressed into the gun body as well. Some gun bodies are fabricated from plastic to achieve weight reduction but they are not highly regarded due to their inability to withstand rough handling. Trigger pull is another important factor which can cause operator fatigue. There are minimal spring forces in spray guns which are required to return the fluid needle and the atomizing air valves to their closed position regardless of friction caused by packing seals and dried paint. Accordingly, most spray guns require high trigger force which can cause operator hand, wrist and finger fatigue. U.S. Pat. No. 5,236,129 (Grime et al.) makes claims to exceptionally light trigger forces based on the action of added internally designed pilot valves.

Because air supplying equipment is used to provide air to all air atomizing guns and because the cost of operating this equipment must be factored into the total cost of painting, it is important to obtain efficient ratios of paint atomization to the amount of air used in order to achieve overall cost efficiency.

SUMMARY OF THE INVENTION

According to this invention an improved HVLP spray gun which operates from an air supply source is provided. The HVLP gun has a fluid nozzle including an integral laterally extending portion including pressure reduction orifices which are calibrated, relative to a fluid passage in the nozzle, so that the spray gun operates as an HVLP spray gun. Specifically, the pressure reduction orifices reduce the pressure of the atomizing air to a level of 10 PSI or less within the air cap chamber of the spray cap assembly of the gun. It is preferred that the laterally extending portion include a plurality of calibrated pressure reduction orifices to effect the required pressure reduction while allowing for the required high air volume needed to atomize the fluid stream exiting from the fluid nozzle. According to a further embodiment of this invention, the fluid nozzle includes a second laterally extending portion including a surface against which atomization air impinges after exiting the calibrated pressure reduction orifices. The second outwardly extending portion includes a plurality of longitudinally extending air distribution holes, preferably positioned radially outwardly from the location of the calibrated pressure reduction orifices so that atomization air, after passing through the pressure reduction orifices is directed radially outwardly in an expansion chamber between the first and second laterally extending portions of the fluid nozzle where the low velocity air is pressure equalized before exiting through the air distribution holes. After passing through the distribution holes, the evenly distributed high volume of low pressure air is directed within the air cap inwardly toward a fluid atomizing annulus created by a concentric hole in the air cap and an outer cylindrical concentric fluid nozzle surface from which the fluid to be atomized will exit. Confusion that a gun user normally feels about the use of most spray guns where there are multiple variables of separate spray caps, separate nozzles, and separate air pressure reduction baffles, all of which must be used in the proper combination in order to achieve desired atomization of paint, is eliminated by the HVLP spray gun of the present invention.

It is preferred that the spray gun body be fabricated completely of aluminum. To make the surface of the aluminum sufficiently hard so that it will not become dented or scarred during handling, the gun body is first machined and then hard coat anodized. This process creates a deep oxide surface which is extremely hard and resistive to surface damage. Teflon material is then vacuumized into the depressions in the hexagonal oxide surface, thereby creating uniquely protective interior and external surfaces of the gun. The following advantages are the result of this unusual surface treatment of the spray gun: 1. The aluminum oxide surface is extremely hard and resists damage and blemishes caused by rough handling. 2. The impregnation of inert teflon into all oxide surfaces helps the surfaces to shed all fluid materials, thereby making the gun surface very easy to clean. 3. The oxide anodized base with the teflon impregnation creates an internal surface in the fluid passages which is impervious to waterborne paints and solvents, and to corrosive and abrasive fluids. 4. The surface treatment of this improved spray gun eliminates the need to use stainless steel inserts in order to withstand waterborne and abrasive fluids thereby reducing the weight of this spray gun embodiment. 5. Elimination of separately machined stainless steel inserts and the assembly of these inserts into the aluminum body as seen in most spray guns reduces the manufacturing cost of the spray gun according to the invention.

In a second embodiment of the invention, the force required to pull the gun trigger is reduced. In most conventional spray guns, the fulcrum of the trigger is located well above the horizontal air passage near the top of the gun body barrel with considerable distance to the spring loaded needle connection point. The trigger fulcrum of this invention is located below the air passage section of the body, creating a lever advantage by placing the trigger pivot point close to the spring loaded fluid needle and air valve assembly contact point, which reduces the needle opening finger force on the trigger. It is preferred to further reduce the trigger pull force, and make it easier to operate a spray gun according to the invention, by providing roller bearings which are supported on and extend outwardly from the needle, perpendicular to its longitudinal axis. The rollers are engaged by a rear concave radial surface of the trigger contact area. As the trigger is pulled back, the rear curved surface of the trigger which makes contact with the rollers causes the rollers to rotate as the needle is moved backward against its spring force, thereby reducing the friction between the needle and trigger.

In yet another embodiment of the present invention, there is a double taper provided on the front outer surface of a fluid exit tube of a fluid nozzle. Atomization air exits from an annulus contained within a hole in the front of an air cap which contains the fluid exiting tube concentrically at its center. Because the atomization air which causes the atomization of the fluid exiting the fluid tube moves generally horizontally along the outer front surface of the fluid tube, the taper on the front of the outer edge of the fluid tube causes a reduction of pressure at its tapered edge and consequently draws the atomizing air inwardly into the exiting fluid stream surface where the tapered edge on the fluid tube meets the fluid stream. Because the atomizing air is driven into the emerging fluid stream exactly at the point the fluid stream exits the fluid tube, atomization occurs very close to the front surface of the gun cap. This results in improved atomization as well as a reduction in the air volume required to cause the atomization.

It is an object of this invention to provide an HVLP spray gun fluid nozzle with a fluid outlet and a laterally extending portion including pressure reduction orifices which are calibrated to the fluid outlet and operable to throttle high pressure air for atomizing a fluid stream exiting the nozzle under HVLP conditions.

Accordingly, it is an object of this invention to provide an improved air atomizing spray gun which is lighter than most competitive types and which can be operated with less trigger pull, thereby reducing operator fatigue.

It is another object of the invention to provide a spray gun whose interior and exterior surfaces are impervious to all types of destructive fluids, and are easily cleanable.

Other objects and advantages will be apparent to those skilled in the art from the following description of preferred embodiments thereof.

DESCRIPTION OF THE PREFERRED EMBODIMENTS

Figure 1:
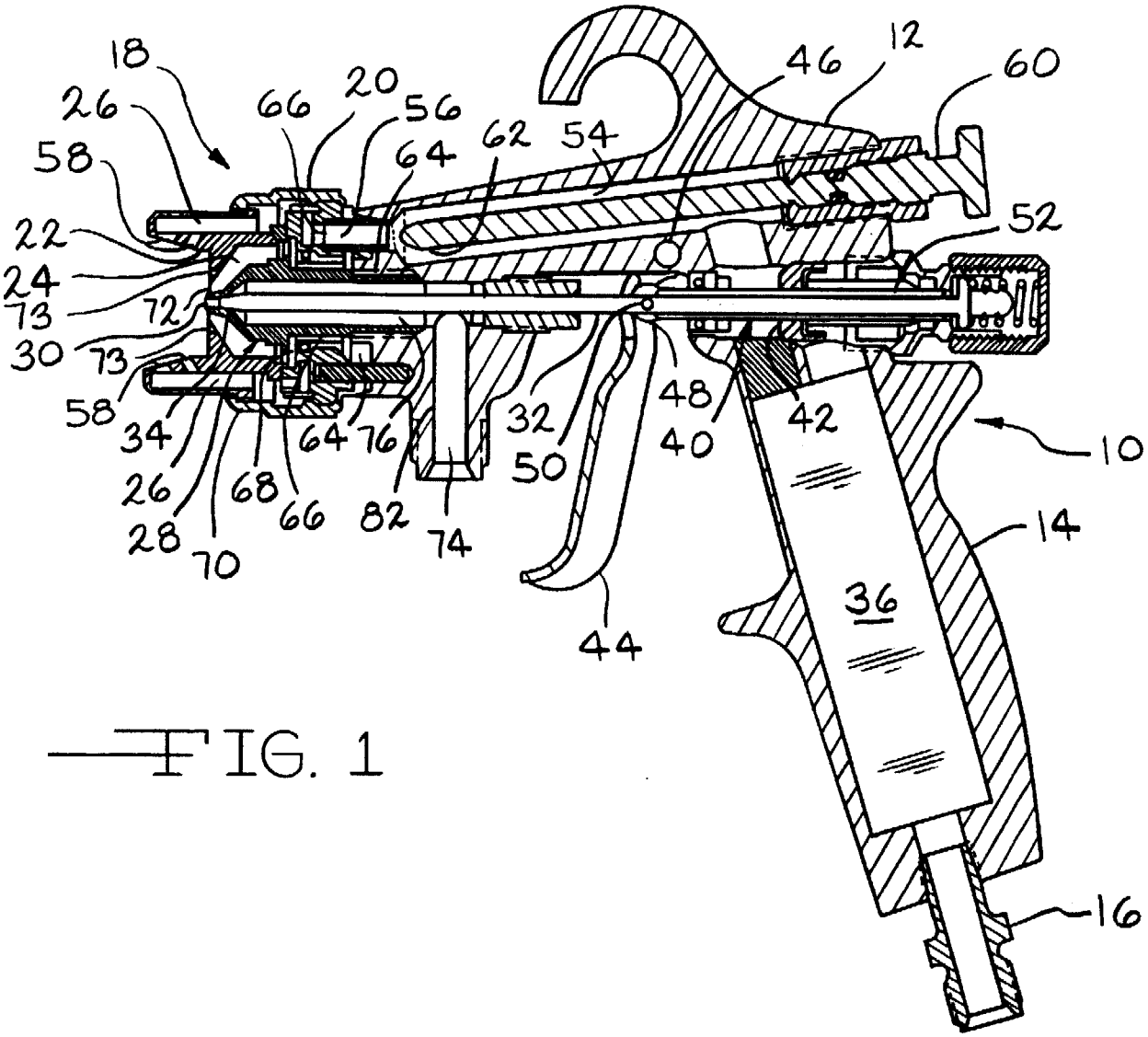
FIG. 1 is a vertical sectional view showing a spray gun according to the instant invention.

An HVLP fluid spray gun according to the invention is indicated generally at 10 in FIG. 1. The gun 10 includes a spray gun body 12 having a handle 14 with a fitting 16 at the base of the handle for connection to a source of air. At the forward end of the gun, there is a spray head assembly indicated generally at 18 which includes an air cap retaining ring 20 and an air cap 22 which provides atomizing air through a passage 24 and pattern air through a passage 26. A fluid nozzle 28 is also a part of the spray head assembly 18. Fluid to be atomized is prevented from flowing through a passage 30 in the fluid nozzle 28 when the front portion of a needle 32 is in the position shown so that a tapered tip thereof closes the passage 30. When the needle 32 is withdrawn to the right from the position shown, fluid is free to flow through the passage 30 in the front end of the fluid nozzle 28.

A supply air passage or chamber 36 extends through the handle 14. In the position shown, an air valve 40 prevents the flow of air from the supply air passage 36. The air valve 40 is carried by a needle actuating assembly indicated generally at 42, which is moveable to the rear of the gun 10, i.e., to the right in FIG. 1, when the lower end of a trigger 44, which is pinned to the body 12 as indicated at 46, is moved toward the handle 14, causing a concave rear portion of the trigger 44 to contact a roller bearing 48 which is pinned to the needle 32 and to the needle actuating assembly 42 as indicated at 50, and move the needle 32 and the assembly 42 to the right, opening the passage 30 of the fluid nozzle 28 and the air valve 40, and compressing a spring 52. When the pressure on the trigger 44 is released, the spring 52 causes the needle 32 and the needle actuating assembly 42 to return to the position shown. So long as the lower part of the trigger 44 is held in a position closer to the handle 14 than that shown, the air valve 40 is open, and the needle 32 no longer prevents the flow of fluid through the passage 30 from the interior of the fluid nozzle 28.

When the trigger 44 is moved toward the handle 14, pressurized air which enters the air passage 36 can flow through the air valve 40 into a first chamber 54, from which fan or pattern air can flow into a second chamber 56 and then into the passage 26 and through air pattern holes 58, compressing the normally circular atomized fluid stream emitted from the fluid outlet passage 30 of the nozzle 28, into a narrow straight line pattern. Fan air volume, which controls the size of the narrow atomized fluid pattern, can be adjusted by moving a fan adjusting needle 60 in or out of the second chamber 56 by rotating the needle 60 clockwise or counterclockwise.

Atomizing air exits the first chamber 54 through apertures 62 located before the fan air adjustment needle 60 lowers the air pressure in the fan air cavity 56 and, consequently, the pressure of atomizing air is unaffected by the fan air adjustment. The atomizing air flows into and through a third chamber 64, then into and through fluid nozzle pressure reduction orifices 66 (see, also, FIGS. 2 and 3), into a fourth, pressure equalizing chamber 68, through air distribution holes 70, into the atomizing air passage 24, sometimes referred to hereinafter as a fifth chamber, and then through an atomizing air annulus 72 where it atomizes exiting fluid from the fluid outlet passage 30 of the fluid nozzle 28. Atomizing air also flows from the passage 24 through holes 73.

Figure 2:
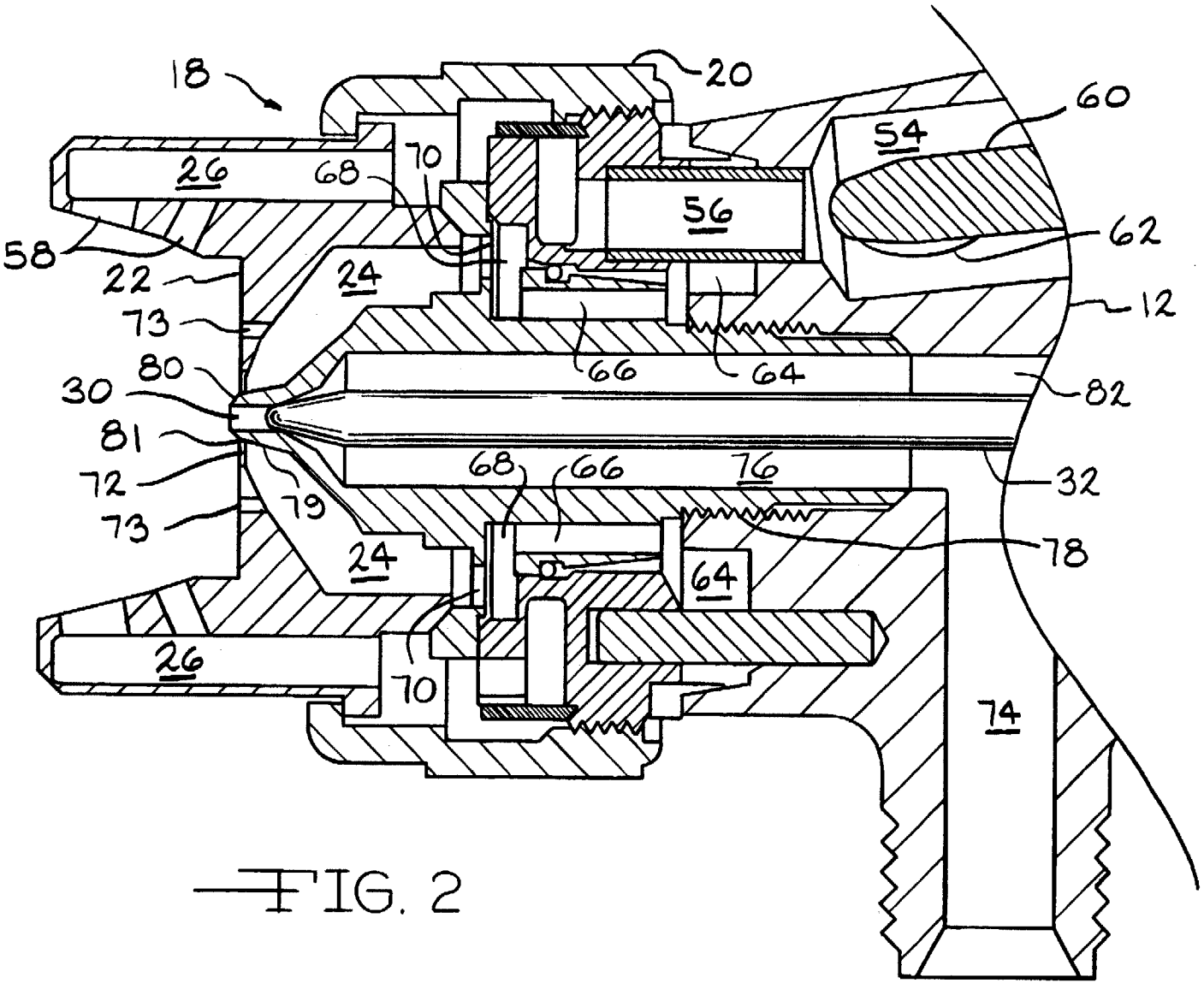
FIG. 2 is an enlarged view in vertical section showing the front end of the spray gun of FIG. 1.
Figure 3:
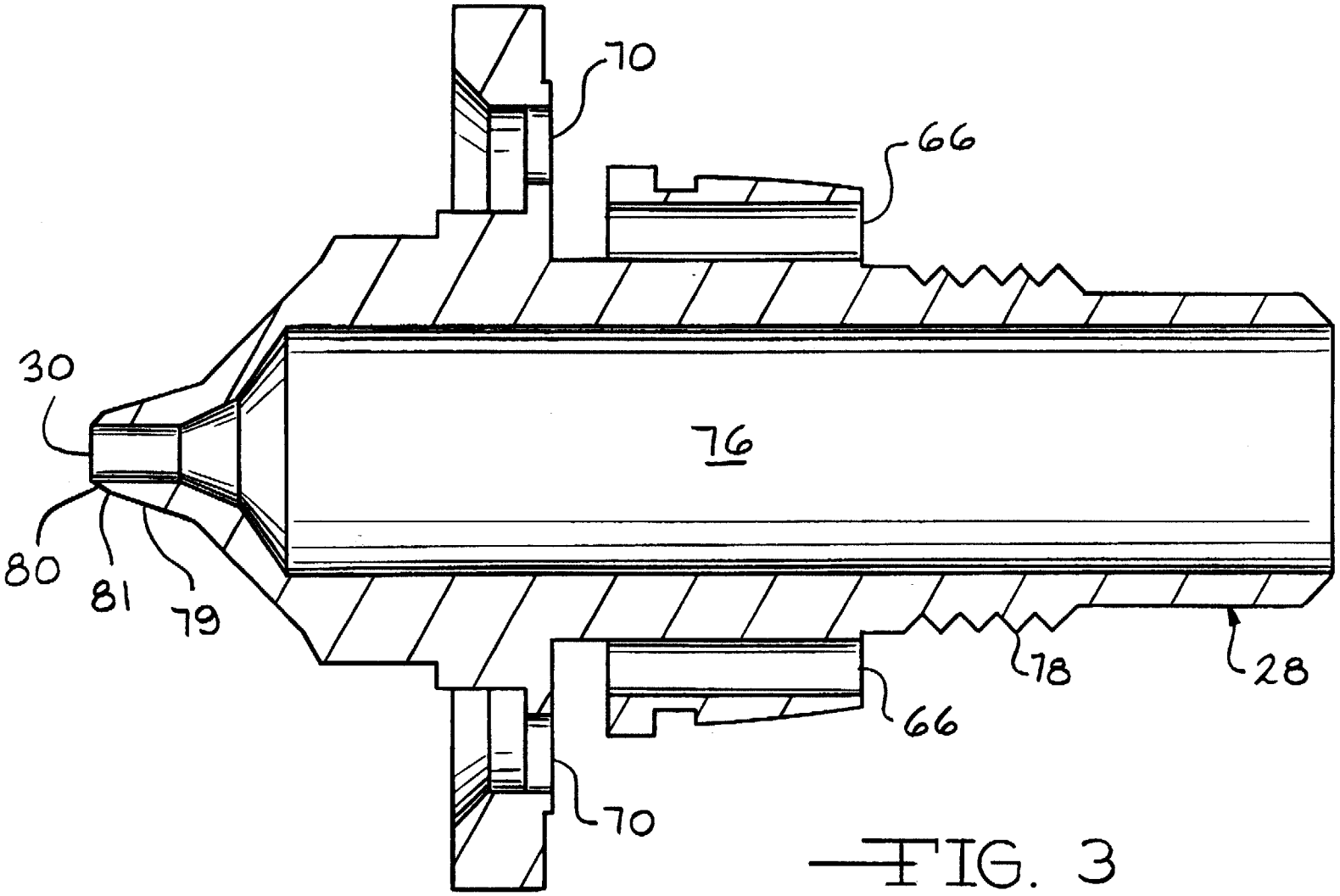
FIG. 3 is a view in horizontal section showing a fluid nozzle according to the invention which is a part of the spray gun of FIGS. 1 and 2.

FIG. 2 shows the spray head assembly 18 of the fluid spray gun 10, including the air cap 22, the fluid nozzle 28 and the air cap retaining ring 20 mounted on the front portion of the gun body 12. When the gun is in operation, fluid under pressure enters a gun body fluid inlet 74 from which it flows into a cavity 76 of the fluid nozzle 28, which is threadably engaged with the body 12, as indicated at 78. Since the needle 32 is withdrawn to the right during operation of the gun 10, the fluid which enters the cavity 76 flows through the opening or fluid outlet passage 30 of the nozzle 28 and is atomized by air which flows through the apertures 62, and through the third chamber 64, the fluid nozzle pressure reduction orifices 66, the fourth, pressure equalizing, chamber 68, the distribution holes 70, and into the atomizing air passage or fifth chamber 24, and then through the atomizing annulus 72 to atomize fluid leaving nozzle 28. Atomizing air leaving the annulus 72 flows along a first tapered portion 79 of the nozzle 28 and past a tapered forward end 80 of the nozzle 28. The tapered forward end 80 is more severely tapered than the first tapered portion 79. There is a pressure reduction as a consequence of atomization air flowing past the intersection 81 of the first tapered portion 79 and the tapered end 80. Air moves inwardly as a consequence of the reduced pressure, causing it to impinge upon and cause effective atomization of the fluid leaving the opening 30 of the fluid nozzle 28.

The pressure reduction orifices 66 extend through a first, laterally extending portion of the nozzle 28. The orifices 66 are calibrated to reduce the pressure of atomization air as it passes through the orifices 66 so that air causes atomization of a fluid stream exiting the fluid outlet passage 30 under HVLP conditions. Excellent results have been achieved, in the case where the fluid outlet passage 30 had a diameter of 0.042 inch (1.10 mm), with three pressure reduction orifices 66, evenly spaced around the nozzle 28, each having a diameter of 0.055 inch (1.40 mm). It is preferred that there be at least three pressure reduction orifices and that the be evenly spaced around the nozzle 28. A differently sized fluid outlet passage 30 will require a different arrangement or size of pressure reduction orifices in order that the nozzle will produce HVLP atomization of an exiting fluid. In any case, the present invention integrates these calibrated pressure reduction orifices with a given fluid outlet passage in a single nozzle, thereby eliminating the need for operators to mix and match fluid nozzles with air pressure reduction baffles according to the prior art.

Air passing through the pressure reduction orifices 66, into the fourth chamber 68, is directed onto a solid portion of a second, laterally extending portion of the nozzle 28. As a consequence, the atomization air flows radially outwardly in the fourth, pressure equalization chamber 68, before passing through the distribution holes. Excellent results have been achieved in the specific embodiment described in the preceding paragraph where there are 12 air distribution holes, equally spaced around the second laterally extending portion of the nozzle 28, each having a diameter of 0.090 inch (2.29 mm).

The gun body 10 is formed from one piece of aluminum which is machined prior to being hard coat anodized. After the hard coat anodizing, the body is subjected to a teflon impregnation process. The anodizing is sufficiently deep in the aluminum that it produces a hard, porous aluminum oxide surface; the teflon impregnation fills the pores, reducing porosity and making it resistant to damage by corrosive fluids. Because of the hardness of the anodized aluminum surface, it is also resistant to damage by abusive handling. All of the surfaces of the fluid spray gun 10, interior and exterior, are preferably subjected to hard coat anodizing and then to teflon impregnation, but the anodizing and teflon impregnation are particularly important on the surfaces which enclose the body fluid inlet 74, the surfaces which enclose the cavity 76 and the passage 30 of the fluid nozzle 28, the needle 32 and the surfaces which enclose a cavity 82 in the body 12 through which a fluid to be atomized must flow between the cavity 74 and the cavity 76. All of these surfaces come into contact with the fluid being atomized. Because they are hard coat anodized and teflon impregnated there is no need for stainless steel in the components where steel was previously considered to be necessary, particularly in the fluid inlet cavity 74. The teflon surface sheds all types of paints and fluids that are used in fluid air guns, offering a lubricous surface which is easy to maintain and clean. Nimet Industries, Inc., 2424 North Foundation Drive, South Bend, Ind. 46628 does hard coat anodizing or hard coat anodizing and teflon impregnation on a custom basis; the machined aluminum or aluminum alloy parts for a fluid spray gun according to the invention which require hard coat anodizing and teflon impregnation can be shipped to the indicated company for the required processing.

It will be apparent to those skilled in the art that various changes and modifications can be made to the preferred embodiments of the invention that have been described without departing from the spirit and scope of the invention as defined in the attached claims. It will also be apparent that the invention is in various improvements to a fluid spray gun of the type that is operated from a source of high pressure air and uses a high volume low pressure flow of air or a high pressure flow from a cap that is releasably attached to and is part of a spray head assembly at the forward end of a gun body for fluid atomization and for pattern shaping of a fluid discharged from a nozzle that, except for a protruding tip, is inside the air-directing cap, and is releasably attached to the gun body, and that the spray gun is one having:

(a) a fluid-inlet for receiving, from a source, fluid to be sprayed, and to deliver the fluid to the interior of the nozzle, (b) a supply-air passage for receiving high pressure air from a source, (c) a first chamber in the gun body operably associated to receive high pressure air from the first-air chamber, (d) a second chamber in the spray head assembly operably associated to receive pattern shaping air from the first chamber, (e) a needle that is resiliently urged into the interior of the nozzle to prevent the flow of fluid therefrom, (f) a valve that is resiliently urged toward a closed position where it prevents the flow of high pressure air from the supply-air passage to the first chamber, and (g) a trigger pinned to the gun body and operably associated with an actuator to withdraw the needle from the interior of the nozzle and to open the valve so that it does not prevent the flow of high pressure air from the supply-air passage to the first chamber.

It will also be apparent that one of the improvements is a longitudinally extending nozzle member which extends through an opening in the cap and has exterior walls spaced from the walls of the cap which surround the opening and form therewith a passage for the flow of air from the supply air chamber to the first chamber, the exterior of said nozzle member having first and second spaced, laterally extending portions. The improved gun further comprises a third chamber, a fourth chamber and means for delivering high pressure air from the first chamber to the third chamber. The first, laterally extending portion of the nozzle separates the third chamber from the fourth chamber and has at least one pressure reduction orifice through which air can flow from the third chamber to the fourth chamber. The second laterally extending portion of the nozzle separates the fourth chamber from a fifth camber which is between the nozzle and the walls of the cap. At least one air distribution orifice is provided in the second laterally extending portion of the nozzle, through which air can flow from the fourth chamber to the fifth chamber. The at least one pressure reduction orifice is calibrated to reduce the pressure of air passing therethrough to that required for atomization of a fluid stream flowing out of the nozzle under HVLP conditions. The nozzle shown in the drawings and described with reference thereto has an exterior surface which is a surface of revolution around the axis of the nozzle. Such an exterior surface is preferred, at least for the portion of the nozzle which cooperates with the cap to form the air annulus through which air flows from the fifth chamber 24.

According to others of the improvements, all of the components of the gun are composed of aluminum or of an aluminum alloy; all of the surfaces of the components of the gun are hard coat anodized; and all of the hard coat anodized surfaces of the components of the gun are impregnated with teflon.

The invention is also an improvement to such a spray gun where the body additionally has a structurally integral, downwardly extending handle at its rear end, is one where the trigger is pinned to the body adjacent the lower surface thereof below the first chamber and forward of the gun handle.

According to another improvement, there are bearing shafts that are structurally integral with the needle and extend therefrom in opposite directions in a plane that is perpendicular to the axis of the needle, there is a bearing with a rolling bearing surface mounted on each of said bearing shafts, and the trigger has a concave contact surface on which the bearing surfaces of the bearings roll as the needle is withdrawn from and returned to its position where it prevents the flow of fluid from the nozzle.

The invention is also a longitudinally extending fluid nozzle for a spray gun which has a fluid inlet end that is threaded for engagement with the fluid cavity of a spray gun body, a fluid outlet end, an interior passage extending from the inlet end through the outlet end, and an exterior surface between the inlet end and the outlet end having a central portion that is a surface of revolution about an axis of the nozzle. The surface of revolution has first and second radially enlarged flanges separated from one another longitudinally of the nozzle, the first of the flanges being nearer the inlet end of the nozzle and having a smaller diameter than the second of the flanges which is nearer the outlet end. There are a plurality of bores extending through both of the flanges, the axes of the bores in each flange being substantially equidistant from the axis of the nozzle, and the axes of the bores through the second of the flanges being farther from the axis of the nozzle than are the axes of the bores through the first of the flanges. The bores in the first flange constitute pressure reduction orifices which are calibrated to reduce the pressure of air passing therethrough to that required for atomization, under HVLP conditions, of a fluid stream flowing, out of the nozzle. A preferred nozzle as described in the previous sentence is one wherein the exterior surface of the nozzle, adjacent the outlet end, is a surface of revolution which has such a uniform taper such that the exterior diameter of the nozzle is substantially equal to the interior diameter thereof at the discharge end.

I claim:

1. In an HVLP fluid spray gun of the type that is operated from a source of high pressure air and uses a high volume low pressure flow of air from a cap that is releasably attached to and is part of a spray head assembly at the forward end of a gun body for HVLP fluid atomization and uses air for pattern shaping of a fluid discharged from a nozzle that is concentric with and, except for a protruding tip, inside the air-directing cap, and is releasably attached to the gun body, said spray gun having:

(a) a fluid inlet for receiving, from a source, fluid to be sprayed, and to deliver the fluid to the interior of the nozzle, (b) a supply-air passage for receiving high pressure air from a source, (c) a first chamber in the gun body, in fluid communication with the supply-air passage, and operable to receive high pressure air therefrom, (d) a second chamber in the spray head assembly, in fluid communication with the first chamber, and operable to receive pattern shaping air therefrom, (e) a needle that is resiliently urged into the interior of the nozzle to prevent the flow of fluid therefrom, (f) a valve that is resiliently urged toward a closed position where it prevents the flow of high pressure air from the supply-air passage to the first chamber, and (g) a trigger pinned to the gun body and operably associated with an actuator to withdraw the needle from the interior of the nozzle and to open the valve so that it does not prevent the flow of high pressure air from the supply-air passage to the first chamber, the improvement wherein said gun comprises a third chamber, a fourth chamber and means for delivering high pressure air from said first chamber to said third chamber, wherein the nozzle comprises a longitudinally extending nozzle member having a first, laterally extending portion which separates said third chamber from said fourth chamber and which has at least one pressure reduction orifice through which air can flow from said third chamber to said fourth chamber, said nozzle having a second, laterally extending portion, longitudinally spaced from said first laterally extending portion, wherein said second laterally extending portion separates said fourth chamber from a fifth chamber which is between the nozzle and the walls of the cap, wherein said second, laterally extending portion has at least one air distribution orifice through which air can flow from said fourth chamber into said fifth chamber and wherein said at least one pressure reduction orifice is calibrated to reduce the pressure of air passing therethrough to that required for HVLP atomization of a fluid stream flowing out of the nozzle.

2. In a fluid spray gun as claimed in claim 1, the further improvement wherein all of the components of the gun body are composed of aluminum or of an aluminum alloy.

3. In a fluid spray gun as claimed in claim 2, the further improvement wherein all of the surfaces of the gun body are hard coat anodized.

4. In a fluid spray gun as claimed in claim 3, the further improvement wherein all of the hard coat anodized surfaces of the gun body are impregnated with teflon.

5. In a fluid spray gun as claimed in claim 1 where the body additionally has a structurally integral, downwardly extending handle at its rear end, the further improvement wherein the trigger is pinned to the body adjacent the lower surface thereof, below said first chamber and forward of the gun handle.

6. In a fluid spray gun as claimed in claim 5, where there are bearing shafts that are structurally integral with the needle and extend therefrom in opposite directions in a plane that is perpendicular to the axis of the needle, there is a bearing with a rolling bearing surface mounted on each of said bearing shafts, and the trigger has a concave contact surface on which the bearing surfaces of said bearings roll as the needle is withdrawn from and returned to its position where it prevents the flow of fluid from the nozzle.

7. A longitudinally extending fluid nozzle for an HVLP spray gun, said nozzle having a fluid inlet end that is threaded for engagement with the fluid cavity of a spray gun body, a fluid outlet end having a fluid outlet passage, an interior passage extending from the inlet end through the outlet end, and an exterior surface between the inlet end and the outlet end having first and second laterally extending flanges separated from one another longitudinally of said nozzle, the second of said flanges being nearer the outlet end of said nozzle than the first of said flanges which is nearer the inlet end, and there being a plurality of bores extending through said first flange and a plurality of bores extending through said second flange, wherein the axes of the bores through said second laterally extending flange are farther from the axis of said nozzle than are the axes of the bores through said first laterally extending flange, wherein the bores in said first flange constitute pressure reduction orifices which are calibrated to reduce the pressure of high pressure air passing therethrough to that required for HVLP atomization of a fluid stream flowing through said fluid outlet passage and out of said fluid outlet end and wherein the bores in said first flange are operable to direct air passing therethrough towards a surface of said second flange and not directly towards the bores in said second flange so that the atomization air impinges on said surface of said second flange, and is directed radially outwardly and its velocity is reduced, before it passes through the bores in said second flange.

8. The longitudinally extending fluid nozzle as claimed in claim 7 wherein the exterior surface of said nozzle, adjacent the outlet end, is a first surface of revolution which has a first, uniform taper, wherein the outlet end is a second surface of revolution which intersects the first surface of revolution and has a second, uniform taper, wherein the second taper is more severe than the first and wherein, when atomization air flows past the intersection of the first and second surfaces of revolution, there is pressure reduction adjacent the intersection which promotes atomization of a sprayed fluid.

9. The longitudinally extending fluid nozzle as claimed in claim 7 wherein the outer surfaces of said first and second flanges and the outer surface of said nozzle between said flanges are surfaces of revolution around the axis of said nozzle.

10. In a fluid spray gun as claimed in claim 1, the improvement wherein the outer surfaces of said first and second spaced, laterally extending portions and the exterior wall of said nozzle between said first and second laterally extending portions are surfaces of revolution about the axis of said nozzle.

11. In a fluid spray gun as claimed in claim 1, the further improvement wherein said nozzle member is composed of aluminum or aluminum alloy and wherein the surfaces of said nozzle member are hard coat anodized and impregnated with teflon.

12. A fluid spray gun comprising (a) a body, (b) a longitudinally extending nozzle member, (c) a fluid inlet for receiving, from a source, fluid to be sprayed, and to deliver the fluid to the interior of said nozzle, (d) a supply-air passage for receiving high pressure air from a source, (e) a first chamber in said gun body, in fluid communication with said supply-air passage, and operable to receive high pressure air therefrom, (f) a second chamber, in fluid communication with said first chamber, and operable to receive pattern shaping air therefrom, (g) a needle that is resiliently urged into the interior of said nozzle to prevent the flow of fluid therefrom, (h) a valve that is resiliently urged toward a closed position where it prevents the flow of high pressure air from said supply-air passage to said first chamber, and (i) a trigger pinned to said gun body and operably associated with an actuator to withdraw said needle from the interior of said nozzle and to open said valve so that it does not prevent the flow of high pressure air from said supply-air passage to said first chamber, (j) a third chamber, (k) a fourth chamber, (l) means for delivering high pressure air from said first chamber to said third chamber, wherein said nozzle member comprises a first, laterally extending portion which separates said third chamber from said fourth chamber and which has at least one pressure reduction orifice through which air can flow from said third chamber to said fourth chamber, a second, laterally extending portion, longitudinally spaced from said first laterally extending portion, wherein said second laterally extending portion separates said fourth chamber from a fifth chamber which is between said nozzle member and the walls of an associated cap, wherein said second, laterally extending portion has at least one air distribution orifice through which air can flow from said fourth chamber into said fifth chamber, and wherein said at least one pressure reduction orifice is calibrated to reduce the pressure of air passing therethrough to that required for HVLP atomization of a fluid stream flowing out of said nozzle member.

13. In a fluid spray gun as claimed in claim 1, the further improvement wherein said second laterally extending portion has a diameter greater than that of said first laterally extending portion and wherein the axes of the bores through said second laterally extending portion are farther from the axis of said nozzle than are the axes of the bores through said first laterally extending portion.

14. The nozzle claimed in claim 7 wherein said second laterally extending flange has a diameter greater than that of said first laterally extending flange.

15. The fluid spray gun claimed in claim 12, wherein said second laterally extending portion has a diameter greater than that of said first laterally extending portion and wherein the axes of the bores through said second laterally extending portion are farther from the axis of said nozzle than are the axes of the bores through said first laterally extending portion.

* * * * *